US008149196B2

(12) United States Patent
Baek

(10) Patent No.: US 8,149,196 B2
(45) Date of Patent: Apr. 3, 2012

(54) DISPLAY DEVICE AND APPARATUS AND METHOD FOR DRIVING THE SAME

(75) Inventor: Heum Il Baek, Kyonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 1869 days.

(21) Appl. No.: 11/311,497

(22) Filed: Dec. 20, 2005

(65) Prior Publication Data

US 2006/0256054 A1 Nov. 16, 2006

(30) Foreign Application Priority Data

May 10, 2005 (KR) ..... 10-2005-0038849

(51) Int. Cl.
*G09G 3/36* (2006.01)

(52) U.S. Cl. ..... 345/88; 345/690

(58) Field of Classification Search ..... 345/83, 345/690, 87–89, 98, 100, 204, 589–605; 348/630, 655, 679
See application file for complete search history.

(56) References Cited

U.S. PATENT DOCUMENTS 7,151,517 B2 * 12/2006 Lee ..... 345/88
7,365,722 B2 * 4/2008 Lee ..... 345/88
7,483,011 B2 * 1/2009 Yang et al. ..... 345/88

FOREIGN PATENT DOCUMENTS

KR 10-2002-0013830 A 2/2001
WO WO 2004/092812 A1 10/2004

* cited by examiner

*Primary Examiner* — Regina Liang
(74) *Attorney, Agent, or Firm* — Birch, Stewart, Kolasch & Birch, LLP

(57) ABSTRACT

A display device, and an apparatus and method for driving the display device are provided, to obtain a rapid speed in a calculation circuit for converting data of three colors to data of four colors, and to perform various algorithms for extracting white color data with one data converter. The apparatus in one embodiment includes a data driver for supplying video data signals to the respective sub-pixels; a gate driver for supplying scan signals to the respective sub-pixels; a data converter for extracting a plurality of white color signals by using three-color source data, and for generating white color data based upon a selection signal, so as to convert the three-color source data to four-color data; and a timing controller for supplying the four-color data outputted from the data converter to the data driver, and controlling the gate driver and the data driver.

31 Claims, 6 Drawing Sheets

DISPLAY DEVICE AND APPARATUS AND METHOD FOR DRIVING THE SAME

This Nonprovisional Application claims priority under 35 U.S.C. §119(a) on Patent Application No. 10-2005-0038849 filed in Korea on May 10, 2005, the entire contents of which are hereby incorporated by reference.

BACKGROUND OF THE INVENTION

1. Field of the Invention

The present invention relates to a display device such as a liquid crystal display (LCD) device, and more particularly, to an apparatus and method for driving a display device, to obtain a rapid speed in a calculation circuit for converting data of three colors to data of four colors.

2. Discussion of the Related Art

In general, a cathode ray tube (CRT), which is one type of flat display devices, cannot satisfy the demands for compact size and lightweight due to its big size and heavy weight. Thus, various display devices, for example, a liquid crystal display (LCD) device using electric field optical effect, a plasma display panel (PDP) using a gas discharge, a filed emission display device, and an electroluminescence display (ELD) device using an electric field luminous effect, have been studied to substitute for the CRT.

The LCD device includes a TFT substrate, a color filter substrate and a liquid crystal layer. The TFT substrate is provided with a plurality of liquid crystal cells in pixel regions defined by a plurality of gate and data lines, and a plurality of thin film transistors, wherein the thin film transistors functions as switching devices for the liquid crystal cells. The color filter substrate having a color filter layer is positioned opposite to the TFT substrate at the predetermined interval. Then, the liquid crystal layer is formed between the TFT substrate and the color filter substrate.

In the LCD device, an electric field is formed in the liquid crystal layer according to a data signal, thereby obtaining the desired picture image by controlling the transmissivity of light passing through the liquid crystal layer. The data signal is inversed by frame, line or dot, so as to prevent the deterioration generated when the electric field of one direction is applied to the liquid crystal layer for a long time.

The LCD device realizes a color picture image by mixing the light of red, green and blue from three color dots of red, green and blue. However, in case of the general LCD device having sub-pixels of the three color dots of red, green and blue, the light efficiency may be lowered in the LCD device. Specifically, color filters formed in the sub-pixels of red, green and blue transmit one-third of the light, whereby the entire light efficiency is lowered.

In order to maintain the color realization ratio and to improve the light efficiency of the LCD device, Korean Patent Application No. P2002-13830 (LCD device) discloses an RGBW type LCD device which includes a white color filter W as well as red, green and blue color filters. Also, Korean Patent Registration No. 464323 (apparatus and method for changing brightness of image) discloses an apparatus and method for converting three-color input elements to four-color elements.

However, when outputting red, green and blue values in these LCD devices, it requires a calculation circuit. Therefore, it has the disadvantage such as a slow operation speed.

Also, the apparatus and method for converting three-color input elements to four-color elements include a plurality of division calculation circuits.

In comparison with the operation speed of addition, subtraction and multiplication, the operation speed of division is slower. Thus, in order to perform the real time calculation, it has clock latency in correspondence with clocks by using a pipeline structure. Accordingly, if the division calculation increases, the clock latency of the entire calculation also increases, whereby it requires a plurality of registers. As a result, the apparatus and method for enhancing brightness of image has the disadvantage of the low operation speed due to the plurality of division calculation circuits.

SUMMARY OF THE INVENTION

Accordingly, the present invention is directed to an apparatus and method for driving an LCD device that substantially obviate one or more problems due to limitations and disadvantages of the related art.

An object of the present invention is to provide an apparatus and method for driving a display device, to obtain a rapid speed in a calculation circuit for converting data of three colors to data of four colors.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving a display device including a panel having sub-pixels of four colors includes a data driver for supplying video data signals to the respective sub-pixels; a gate driver for supplying scan signals to the respective sub-pixels; a data converter for extracting a plurality of white color signals by using three-color source data, and for generating white color data based upon a selection signal, so as to convert the three-color source data to four-color data; and a timing controller for supplying the four-color data outputted from the data converter to the data driver, and controlling the gate driver and the data driver.

In another aspect of the present invention, a method for driving a display device, the display device including a panel having sub-pixels of four colors, a data driver for supplying video data signals to the sub-pixels, and a gate driver for supplying scan signals to the sub-pixels, includes: extracting a plurality of white color data signals by using three-color source data; generating white color data based upon a selection signal, so as to convert the three-color source data to four-color data; generating the scan signals; and converting the four-color data to the video data signals, and supplying the video data signals synchronized with the scan signals to the sub-pixels.

In another aspect of the present invention, a display device includes a panel having sub-pixels of four colors; a data driver for supplying video data signals to the respective sub-pixels; a gate driver for supplying scan signals to the respective sub-pixels; a data converter for extracting a plurality of white color signals by using three-color source data, generating white color data based upon a selection signal, so as to convert the three-color source data to four-color data; and a timing controller for supplying the four-color data outputted from the data converter to the data driver, and controlling the gate driver and the data driver.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, an apparatus and method for driving a display device according to the embodiments of the present invention will be described with reference to the accompanying drawings.

Figure 1:
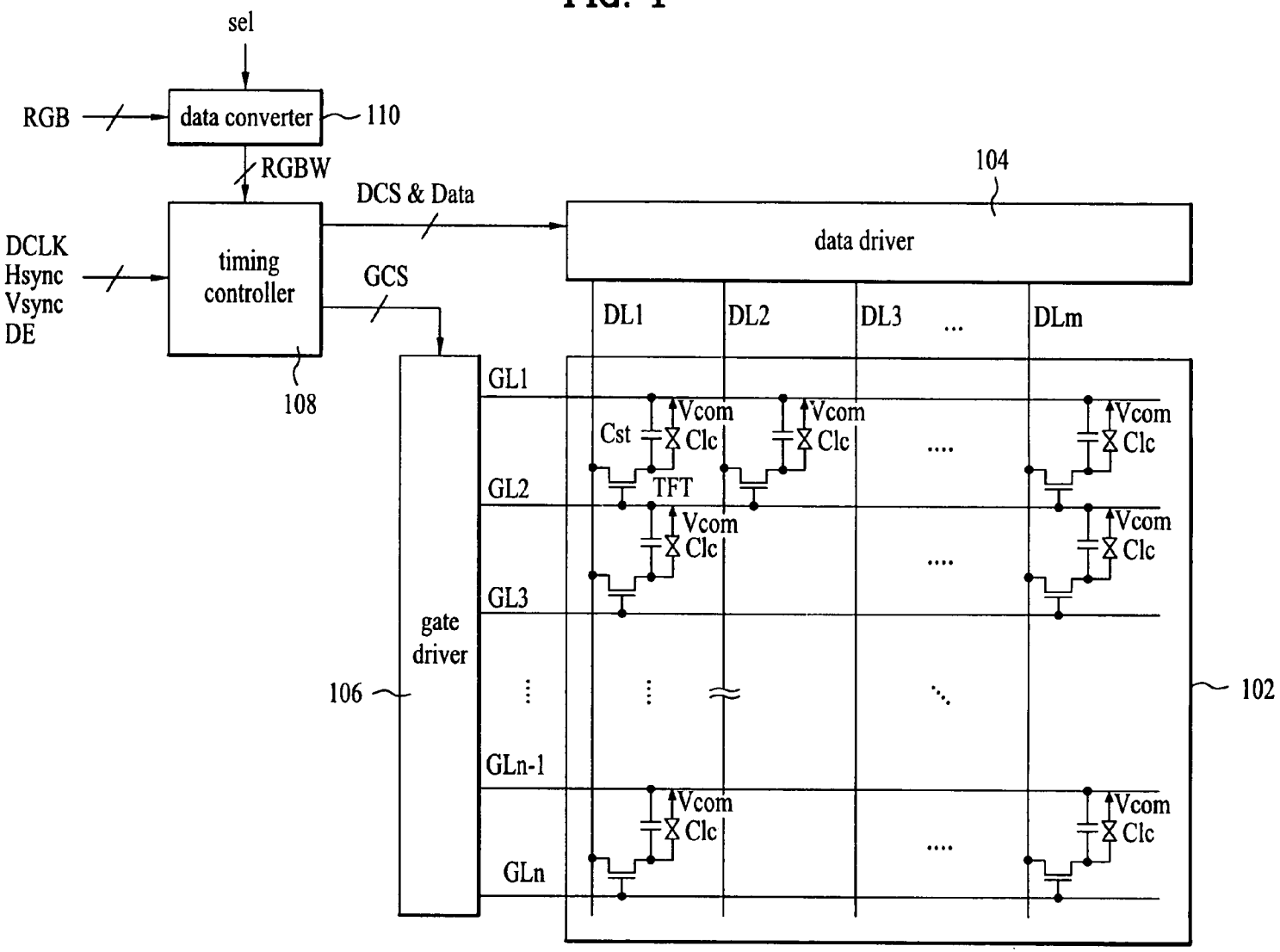
FIG. 1 is a block diagram of an LCD device having a driving apparatus according to a preferred embodiment of the present invention.

FIG. 1 is a block diagram of an LCD device having a driving apparatus according to a preferred embodiment of the present invention. It should be noted that an LCD device is merely used in the following embodiments as an example. The present invention can also apply to convert the three-color source data to four-color data for other display devices including a panel having sub-pixels of four colors.

Referring to FIG. 1, the LCD device according to the preferred embodiment of the present invention includes an LCD panel 102, a data driver 104, a gate driver 106, a data converter 110, and a timing controller 108. In the LCD panel 102, liquid crystal cells are formed in sub-pixels of four colors, the sub-pixels defined by 'n' gate lines (GL1 to GLn) and 'm' data lines (DL1 to DLm). Then, the data driver 104 supplies video data signals to the respective data lines (DL1 to DLm), and the gate driver 106 supplies scan pulses to the respective gate lines (GL1 to GLn). Also, the data converter 110 converts source data of three colors RGB, outputted from the outside, to data of four colors RGBW. The timing controller 108 supplies the data of four colors RGBW outputted from the data converter 110 to the data driver 104, controls the data driver 104 with a data control signal DCS, and controls the gate driver 106 with a gate control signal GCS, at the same time.

The LCD panel 102 includes thin film transistors TFTs at crossing portions of the respective gate lines (GL1 to GLn) and the respective data lines (DL1 to DLm), and liquid crystal cells being in contact with the thin film transistors TFTs. Each thin film transistor TFT responds to the scan pulse outputted from the corresponding gate line (GL1 to GLn), and supplies the data signal of the corresponding data line (DL1 to DLm) to the liquid crystal cell. The liquid crystal cell is provided with a common electrode and a sub-pixel electrode being connected with the thin film transistor, wherein the common electrode is opposite to the sub-pixel electrode in state of interposing the liquid crystal therebetween. Thus, the liquid crystal cell may be equivalently represented as a liquid crystal capacitor Clc. The liquid crystal cell includes a storage capacitor Cst connected with the prior gate line so as to maintain the data signal charged to the liquid crystal capacitor Clc until the next data signal is charged.

In the meantime, the sub-pixels of red(R), green(G), blue (B) and white(W) are repetitively formed along the row direction of sub-pixels in the LCD panel 102. Each of the red(R), green(G) and blue(B) sub-pixels has the corresponding color filter. Meanwhile, the white(W) sub-pixel has no color filter. Also, the red(R), green(G), blue(B) and white(W) sub-pixels may be formed in a stripe structure of the same size ratio or the different size ratios. In this case, the red(R), green(G), blue (B) and white(W) sub-pixels may be formed in a matrix type of 2×2.

The data converter 110 generates a plurality of white(W) color signals determined with a function of a minimum luminance value of the three-color source data RGB inputted from the outside. Then, the data converter 110 converts the three-color source data RGB to the four-color data RGBW by using the white(W) color data based upon a selection signal, and supplies the four-color data RGBW to the timing controller 108.

The timing controller 108 aligns the four-color data RGBW outputted from the data converter 110 to be suitable for the driver of the LCD panel 102, and then supplies the aligned four-color data RGBW to the data driver 104. Also, the timing controller 108 generates the data control signal DCS and the gate control signal GCS based upon a main clock DCLK, a data enable signal DE and horizontally and vertically synchronized signals Hsync and Vsync, and controls the operation timing in the data driver 104 and the gate driver 106 with the data control signal DCS and the gate control signal GCS.

The gate driver 106 includes the shift register, wherein the shift register sequentially generates the scan pulses, that is, gate high pulses in response to a gate start pulse GSP and a gate shift clock GSC among the gate control signals GCS outputted from the timing controller 108. The thin film transistor TFT is turned-on in response to the scan pulse.

The data driver 104 converts the four-color data, aligned in the timing controller 108 according to the data control signal DCS supplied from the timing controller 108, to a video data signal, whereby the video data signal of one-horizontal line is supplied to the data line (DL1 to DLm) by one-horizontal period for supplying the scan pulse to the gate line (GL1 to GLn). That is, the data driver 104 selects a gamma voltage having the predetermined level according to a gray level of four-color data, and supplies the selected gamma voltage to the data line (DL1 to DLm).

Figure 2:
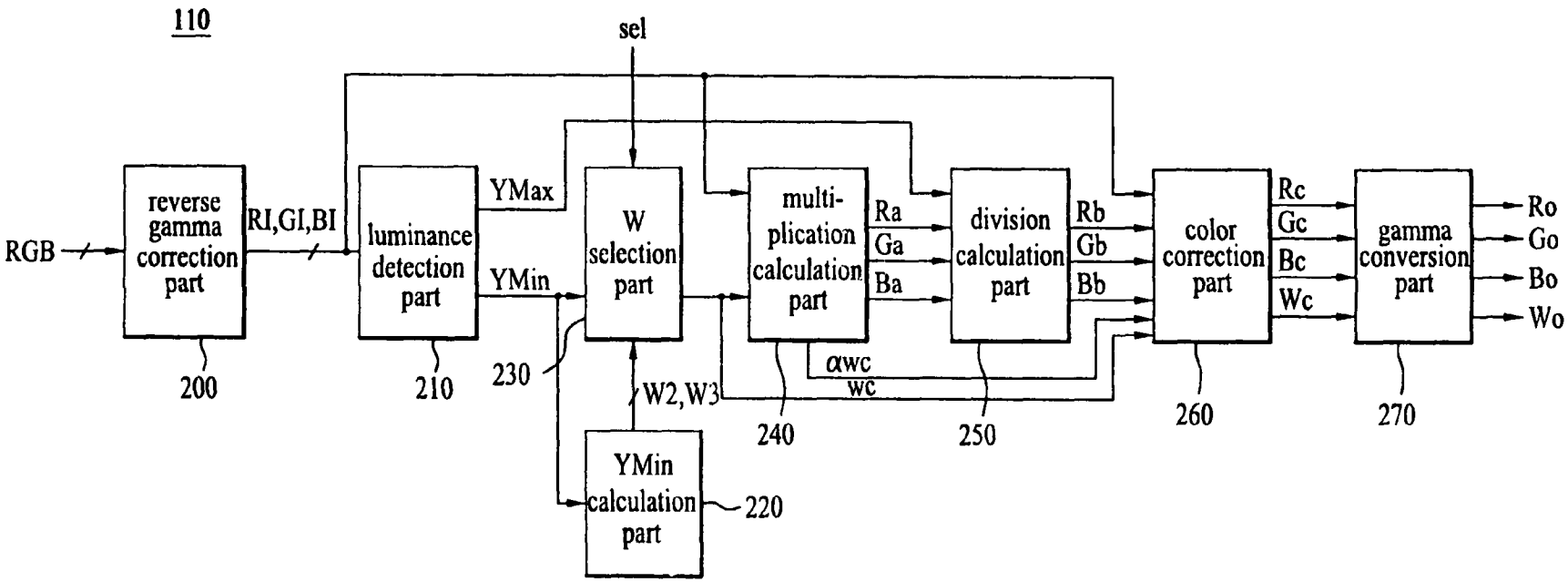
FIG. 2 is a block diagram of a data converter according to the first embodiment of the present invention in a driving apparatus of an LCD device shown in FIG. 1.

FIG. 2 is a block diagram of the data converter according to the first embodiment of the present invention in the driving apparatus of the LCD device shown in FIG. 1.

As shown in FIG. 2 of connection with FIG. 1, the data converter 110 according to the first embodiment of the present invention includes a reverse gamma correction part 200, a luminance detection part 210, a minimum value calculation part 220, a white color selection part 230, a multiplication part 240, a division part 250, a color correction part 260, and a gamma conversion part 270.

The three-color source data RGB are the signals which are gamma-corrected in due consideration of the output characteristics of cathode ray tube. Thus, the reverse gamma correction part 200 converts the linear three-color corrected data RI, GI and BI by the following equation 1.

$$RI=R^{\gamma}$$

$$GI=G^{\gamma}$$

$$BI=B^{\gamma} \qquad \text{equation 1}$$

The luminance detection part 210 detects a maximum luminance value YMax and a minimum luminance value YMin of the three-color corrected data supplied from the reverse gamma correction part 200.

The minimum value calculation part 220 calculates a first white color signal W2 and a second white color signal W3 by using the minimum luminance value YMin supplied from the luminance detection part 210 in the following equations 2 and 3, and then supplies the first and second white color signals W2 and W3 to the white color selection part 230.

$$W2 = 255\times\left(\frac{YMin}{255}\right)^2 \qquad \text{equation 2}$$

$$W3 = \frac{-YMin}{255^2} + \frac{YMin^2}{255} + YMin \qquad \text{equation 3}$$

The minimum value calculation part 220 includes the division calculation as shown in equations 2 and 3. In the division calculation, since the denominator is a constant of 255, the division calculation is performed by 8-bit shift operation. This can be done, for example, by a 8-bit shift register.

Accordingly, the minimum value calculation part 220 does not require a division calculation element. The minimum value calculation part 220 operates with multiplication and addition elements. Thus, the minimum value calculation part 220 generates the first and second white color signals W2 and W3 at a high operation speed.

The white color selection part 230 selects one of the minimum luminance value YMin from the luminance detection part 210 and the first and second white color signals W2 and W3 from the minimum value calculation part 220 according to the white color selection signal inputted from the outside, whereby the selected one is referred to as the white color extraction signal Wc. Then, the selected white color extraction signal Wc is supplied to the multiplication part 240.

The multiplication part 240 multiples the white color extraction signal Wc outputted from the white color selection part 230 by a constant 'α', the weighting factor of white which could be different in each of R, G and B channel, thereby generating a compensation white color extraction signal αWc. Then the multiplication part 240 multiples the compensation white color extraction signal αWc and each of the three-color corrected data RI, GI and BI outputted from the reverse gamma correction part 200, thereby generating first three-color data Ra, Ga and Ba shown in the following equation 4. Then, the first three-color data Ra, Ga and Ba is supplied to the division calculation part 250.

$$Ra=\alpha Wc\times RI$$

$$Ga=\alpha Wc\times GI$$

$$Ba=\alpha Wc\times BI \qquad \text{equation 4}$$

The division part 250 divides the first three-color data Ra, Ga and Ba outputted from the multiplication part 240 by the maximum luminance value YMax outputted from the luminance detection part 210, thereby generating second three-color data Rb, Gb and Bb shown in the following equation 5. Then, the generated second three-color data Rb, Gb and Bb are supplied to the color correction part 260.

$$Rb = \frac{Ra}{YMax} \qquad \text{equation 5}$$

$$Gb = \frac{Ga}{YMax}$$

$$Bb = \frac{Ba}{YMax}$$

As shown in the following equation 6, the color correction part 260 generates four-color data Rc, Gc, Bc and Wc with the three-color corrected data RI, GI and BI outputted from the reverse gamma correction part 200, the second three-color data Rb, Gb and Bb outputted from the division part 250, and the compensation white color extraction signal αWc outputted from the multiplication part 240, and then supplies the generated four-color data to the gamma conversion part 270.

$$Rc=RI+Rb-\alpha Wc$$

$$Gc=GI+Gb-\alpha Wc$$

$$Bc=BI+Bb-\alpha Wc \qquad \text{equation 6}$$

Figure 3:
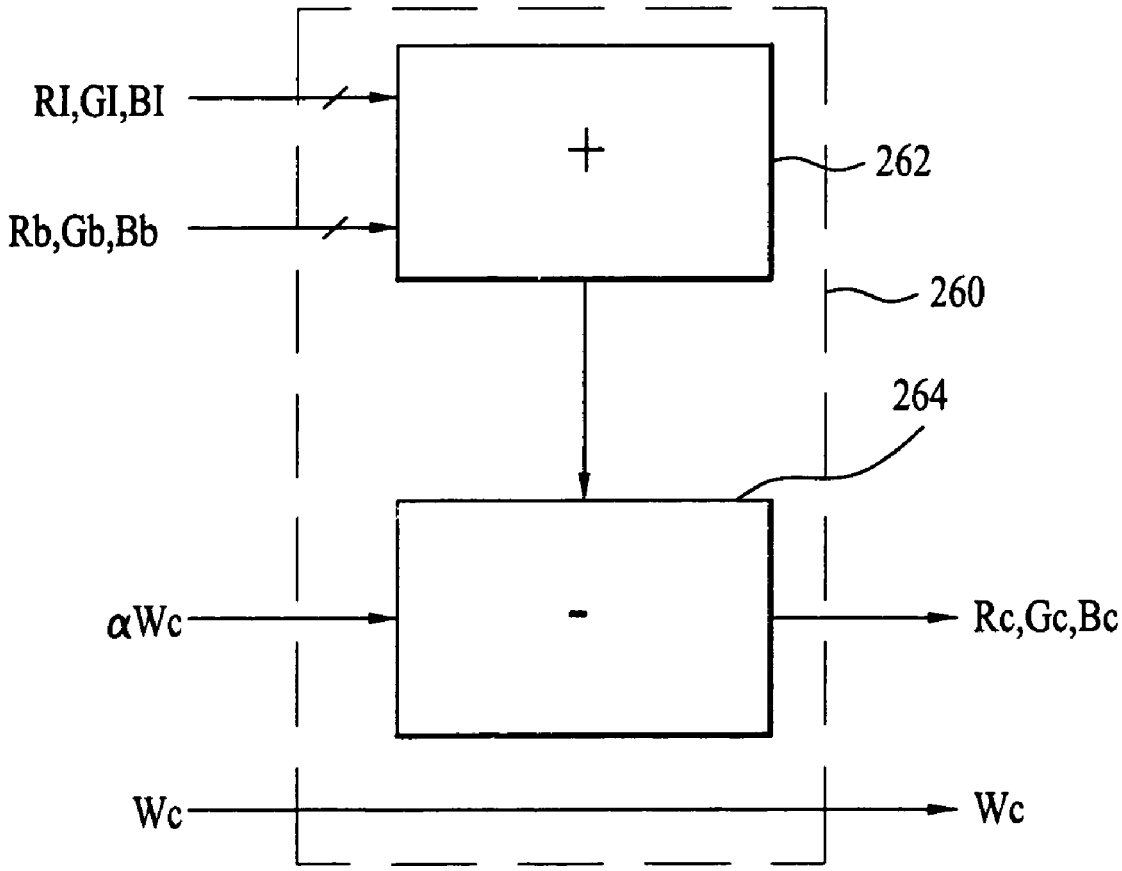
FIG. 3 is a block diagram of a color correction part shown in FIG. 2.

As shown in FIG. 3, the color correction part 260 includes an addition calculation portion 262 and a subtraction calculation portion 264. At this time, the addition calculation portion 262 adds the three-color corrected data RI, GI and BI to the second three-color data Rb, Gb and Bb, and then generates the addition result as the output signal. Then, the subtraction calculation portion 264 subtracts the compensation white color extraction signal αWc from the output signal of the addition calculation part 264, and then outputs third three-color data Rc, Gc and Bc to the gamma conversion part 270.

The color correction part 260 generates the third three-color data Rc, Gc and Bc by using the addition calculation portion 262 and the subtraction calculation portion 264. Simultaneously, the color correction part 260 outputs the white color extraction signal Wc, whereby the four-color data Rc, Gc, Bc and Wc are outputted to the gamma conversion part 270.

The gamma conversion part 270 converts the four-color data Rc, Gc, Bc and Wc to final four-color data Ro, Go, Bo and Wo by performing the gamma-correction of the four-color data Rc, Gc, Bc and Wc outputted from the color correction part 260, as shown in the following equation 7.

$$Ro=(Rc)^{1/\gamma}$$

$$Go=(Gc)^{1/\gamma}$$

$$Bo=(Bc)^{1/\gamma}$$

$$Wo=(Wc)^{1/\gamma} \qquad \text{equation 7}$$

The gamma conversion part 270 converts the four-color data Rc, Gc, Bc and Wc to the final four-color data Ro, Go, Bo and Wo suitable for the driving circuit of the LCD panel 102, according to a Look Up Table. Then, the gamma conversion part 270 supplies the final four-color data Ro, Go, Bo and Wo to the timing controller 108.

Eventually, as shown in the following equation 8, the data converter 110 generates the white color extraction signal Wc and the compensation white color extraction signal αWc from the three-color source data RGB inputted from the outside, generates the final three-color data Ro, Go and Bo with the generated white color extraction signal Wc, and supplies the final four-color data Ro, Go, Bo and Wo including the final three-color data and the white color extraction signal to the timing controller 108.

$$Do = \left(\frac{YMax + \alpha Wc}{YMax} DI - \alpha Wc\right)^{1/\lambda} = \left(DI + \frac{\alpha Wc}{YMax} DI - \alpha Wc\right)^{1/\lambda} \quad \text{equation 8}$$

In the equation 8, 'Do' corresponds to 'Ro', 'Go' and 'Bo', and 'DI' corresponds to 'RI', 'GI' and 'BI'.

An apparatus and method for driving the LCD device according to the first embodiment of the present invention will be described as follows.

First, according to the white color selection signal sel outputted from the outside, the data converter 110 selects one signal as the white extraction signal Wc among the minimum luminance value YMin detected by the luminance detection part 210 and the first and second white color signals W2 and W3 outputted from the minimum value calculation part 220. Then, the data converter 110 respectively multiplies the three-color corrected data RI, GI and BI and the compensated white color extraction signal αWc in the multiplication part 240, and then divides the signal outputted from the multiplication part 240 by the maximum luminance value YMax in the division part 250.

The data converter 110 generates the four-color data Rc, Gc, Bc and Wc by the addition and subtraction calculations with the output signal Ra, Ga and Ba from the division part 250, the three-color corrected data RI, GI and BI, and the white color extraction signal Wc, and then performs the gamma-correction of the four-color data Rc, Gc, Bc and Wc. Thus, the data converter 110 supplies the final three-color data Ro, Go and Bo and the white color data Wo to the timing controller 108.

The apparatus for driving the LCD device according to the first embodiment of the present invention generates the four-color data RGBW at the same point by the data converter 110 including one division part 250 regardless of the algorithms. Accordingly, it is possible to obtain the rapid calculation speed in the data converter 110 for converting the three-color data RGB to the four-color data RGBW.

Figure 4:
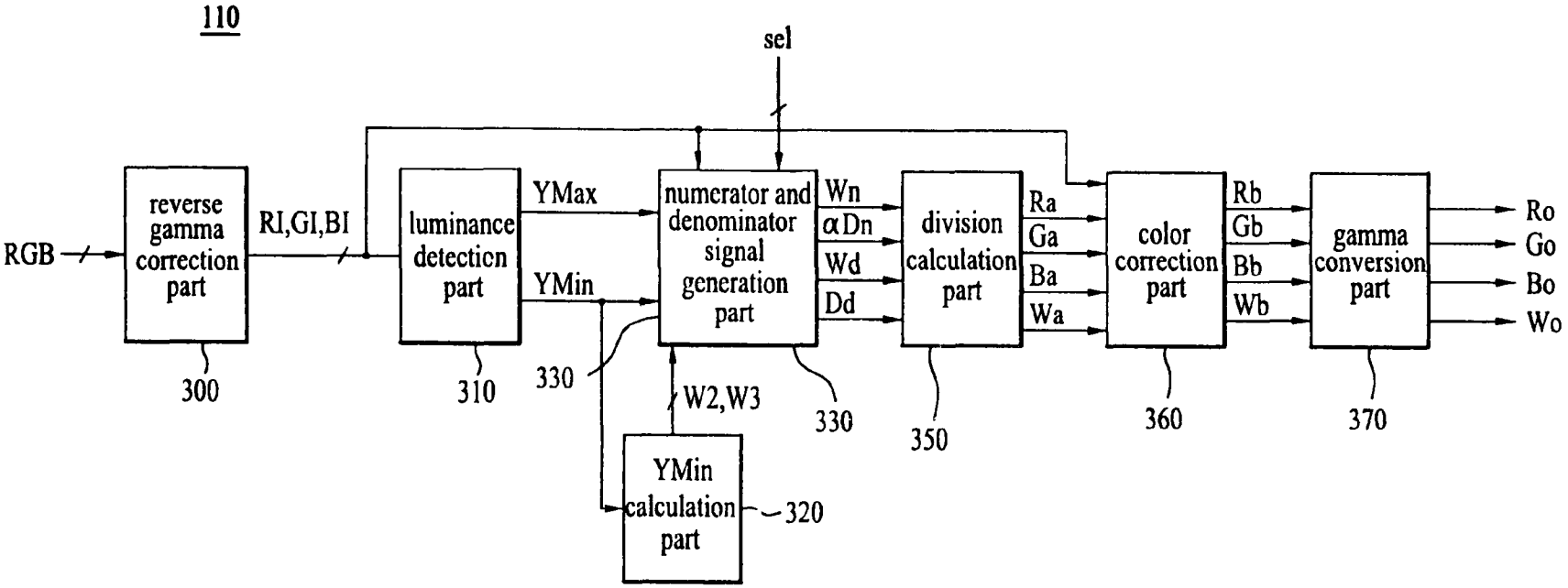
FIG. 4 is a block diagram of a data converter according to the second embodiment of the present invention in a driving apparatus of an LCD device shown in FIG. 1.

FIG. 4 is a block diagram of a data converter according to the second embodiment of the present invention in a driving apparatus of an LCD device shown in FIG. 1.

As shown in FIG. 4 of connection with FIG. 1, a data converter 110 according to the second embodiment of the present invention includes a reverse gamma correction part 300, a luminance detection part 310, a minimum value calculation part 320, a numerator and denominator signal generation part 330, a division part 350, a color correction part 360, and a gamma conversion part 370.

Three-color source data RGB are the signals which are gamma-corrected in due consideration of the output characteristics of cathode ray tube. Thus, the reverse gamma correction part 300 converts the three-color source data RGB to linear three-color corrected data RI, GI and BI by the aforementioned equation 1.

The luminance detection part 310 detects a maximum luminance value YMax and a minimum luminance value YMin of the three-color corrected data supplied from the reverse gamma correction part 300.

The minimum value calculation part 320 calculates the first white color signal W2 and the second white color signal W3 with the minimum luminance value YMin supplied from the luminance detection part 310 by the aforementioned equation 2 and 3, and then supplies the first and second white color signals W2 and W3 to the numerator and denominator signal generation part 330.

The minimum value calculation part 320 comprises the division calculation as shown in equations 2 and 3. In the division calculation, since the denominator is a constant of 255, the division calculation is performed with 8-bit shift operation.

Accordingly, the minimum value calculation part 320 does not require a division calculation element. The minimum value calculation part 320 operates with multiplication and addition elements. Thus, the minimum value calculation part 320 generates the first and second white color signals W2 and W3 at a high speed.

The numerator and denominator signal generation part 330 generates a white color numerator signal Wn, a white color denominator signal Wd, a compensation data numerator signal αDn and a data denominator signal Dd, and then selectively supplies Wn, Wd, Dn and Dd to the division part 350. That is, the numerator and denominator signal generation part 330 generates the numerator and denominator values required for the division calculation in the division part 350.

Figure 5:
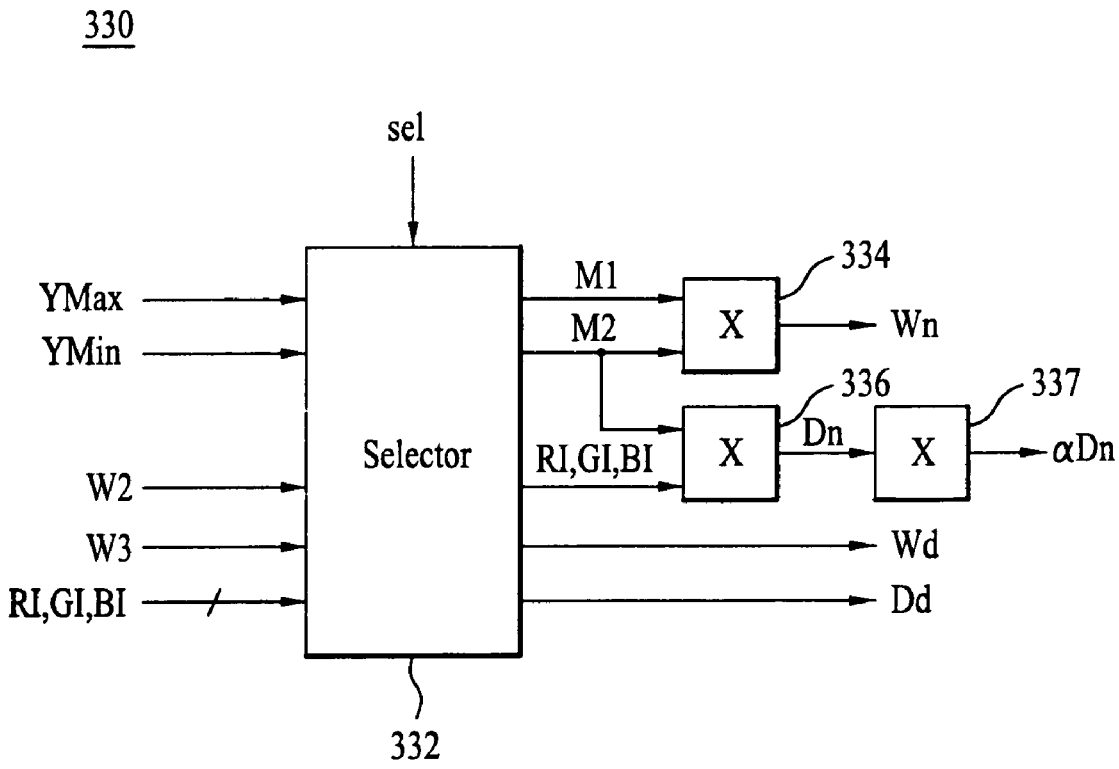
FIG. 5 is a block diagram of a numerator and denominator signal generation part shown in FIG. 4.

As shown in FIG. 5, the numerator and denominator signal generation part 330 includes a selector 332, a first multiplier 334, a second multiplier 336 and a third multiplier 337.

The selector 332 receives the maximum and minimum luminance values YMax and YMin from the luminance detection part 310, the first and second white color signals W2 and W3 from the minimum value calculation part 320, and the three-color corrected data RI, GI and BI from the reverse gamma correction part 300. Then, the selector 332 outputs first and second luminance signals M1 and M2 set as shown in the following Table 1 according to the selection signal sel, the white color denominator signal Wd and the data denominator signal Dd.

TABLE 1

| sel | #0 | #1 | #2 | #3 | #4 | |
|---|---|---|---|---|---|---|
| Algorithm | OFF | YMin | W2 | W3 | W4(Ymax ≦ 2YMin) | W5(YMax > 2YMin) |
| M1(YMax') | 0 | 1 | 1 | 1 | 1 | YMax |
| M2(YMin') | 0 | YMin | W2 | W3 | YMax | YMin |
| Wd | 1 | 1 | 1 | 1 | 1 | YMax − YMin |
| Dd | 1 | YMax | YMax | YMax | YMax | YMax − YMin |

In Table 1, if the inputted selection signal sel is "4", the selector 332 outputs the first and second luminance signals M1 and M2, the white color denominator signal Wd and the data denominator signal Dd, so as to differently generate fourth and fifth white color signals W4 and W5 as shown in the following equation 9.

$$W4 = YMax \leqq 2 \times YMin$$

$$W5 = YMax > 2 \times YMin \qquad \text{equation 9}$$

Although not shown, the selector 332 further includes a shift circuit for generating the minimum luminance value YMin twice, and a comparator for comparing the minimum luminance value YMin generated twice with the maximum luminance value YMax.

Accordingly, the selector 332 selects one of '0', '1' and the maximum luminance value YMax, according to the selection signal sel, and then sets the selected one as the first luminance signal M1. Also, the selector 332 selects one of '0', the minimum luminance value YMin, the maximum luminance value YMax, and the first and second white color signals W2 and W3 according to the selection signal sel, and then sets the selected one as the second luminance signal M2. Also, the selector 332 selects one of '1' and (maximum luminance value(YMax)−minimum luminance value(YMin)) according to the selection signal sel, and then sets the selected one as the white color denominator signal Wd. Then, the selector selects one of '1', maximum luminance value(YMax), and (maximum luminance value(YMax)−minimum luminance value (YMin)) according to the selection signal sel, and then sets the selected one as the data denominator signal Dd.

In more detail, if the selection signal sel is '0', the selector 332 outputs the first and second luminance signals M1 and M2 of '0', and the white color and data denominator signals Wd and Dd of '1', as shown in Table 1.

As shown in Table 1, in case the selection signal sel is '1', the selector 332 outputs the first luminance signal M1 of '1', the second luminance signal M2 of the minimum luminance value YMin, the white color denominator signal Wd of '1', and the data denominator signal Dd of the maximum luminance value YMax.

As shown in Table 1, if the selection signal sel is '2', the selector 332 outputs the first luminance signal M1 of '1', the second luminance signal M2 of the first white color signal W2, the white color denominator signal Wd of '1', and the data denominator signal Dd of the maximum luminance value YMax.

If the selection signal sel is '3', as shown in Table 1, the selector 332 outputs the first luminance signal M1 of '1', the second luminance signal M2 of the second white color signal W3, the white color denominator signal Wd of '1', and the data denominator signal Dd of the maximum luminance signal YMax, as shown in Table 1.

If the selection signal sel is '4' and the maximum luminance value YMax is the fourth white color signal W4 of the equation 9, the selector 332 outputs the first luminance signal M1 of '1', the second luminance signal M2 of the maximum luminance value YMax, the white color denominator signal Wd of '1', and the data denominator signal Dd of the maximum luminance value YMax.

Also, if the selection signal sel is '4' and the maximum luminance value YMax is the fifth white color signal W5 of the equation 9, the selector 332 outputs the first luminance signal M1 of the maximum luminance value YMax, the second luminance signal M2 of the minimum luminance value YMin, the white color denominator signal Wd of 'maximum luminance value(YMax)−minimum luminance value (YMin)', and the data denominator signal Dd of 'maximum luminance value(YMax)−minimum luminance value (YMin)'.

The first multiplier 334 multiplies the first luminance signal M1 and the second luminance signal M2, thereby generating the white color numerator signal Wn as shown in the following equation 10. Then, the generated white color numerator signal Wn is supplied to the division part 350.

$$Wn = M1 \times M2 \qquad \text{equation 10}$$

The second multiplier 336 respectively multiplies the second luminance signal M2 and the three-color corrected data RI, GI and BI, thereby generating the data numerator signal Dn shown in the following equation 11. The third multiplier 337 multiplies the data numerator signal Dn and the weighting factor (α) of white which could be different in each of R, G and B channel, thereby generating a compensation data numerator signal αDn. Then, the generated compensation data numerator signal αDn is supplied to the division part 350.

$$Dn = DI \times M2 \qquad \text{equation 11}$$

In equation 11, 'DI' corresponds to 'RI', 'GI' and 'BI'.

The numerator and denominator values supplied to the division part 350 may be variable according to the algorithms as shown in Table 1. That is, the selector 332 selects the numerator and denominator values according to the selection signal sel.

The division part 350 performs the division calculation of the equation 12 with the first and second luminance signals M1 and M2 from the numerator and denominator signal generation part 330, the white color denominator signal Wd, the data denominator signal Dd, and the compensation data numerator signal αDn, thereby generating first four-color data Ra, Ga, Ba and Wa including the first white color extraction signal Wa and the first three-color data Ra, Ga and Ba. Then, the generated first four-color data Ra, Ga, Ba and Wa are supplied to the color correction part 360.

$$Wa = \frac{Wn}{Wd} \qquad \text{equation 12}$$

$$Da = \frac{\alpha Dn}{Dd}$$

In equation 12, 'Da' corresponds to 'Ra', 'Ga' and 'Ba'.

The color correction part 360 generates second four-color data Rb, Gb, Bb and Wb with the three-color corrected data RI, GI and BI from the reverse gamma correction part 300 and the first four-color data Ra, Ga, Ba and a compensated white color extraction signal αWa from the division part 350, as shown in the following equation 13. Then, the generated second four-color data Rb, Gb, Bb and Wb are supplied to the gamma conversion part 370.

$$Rb = RI + Ra - \alpha Wa$$

$$Gb = GI + Ga - \alpha Wa$$

$$Bb = BI + Ba - \alpha Wa \qquad \text{equation 13}$$

Figure 6:
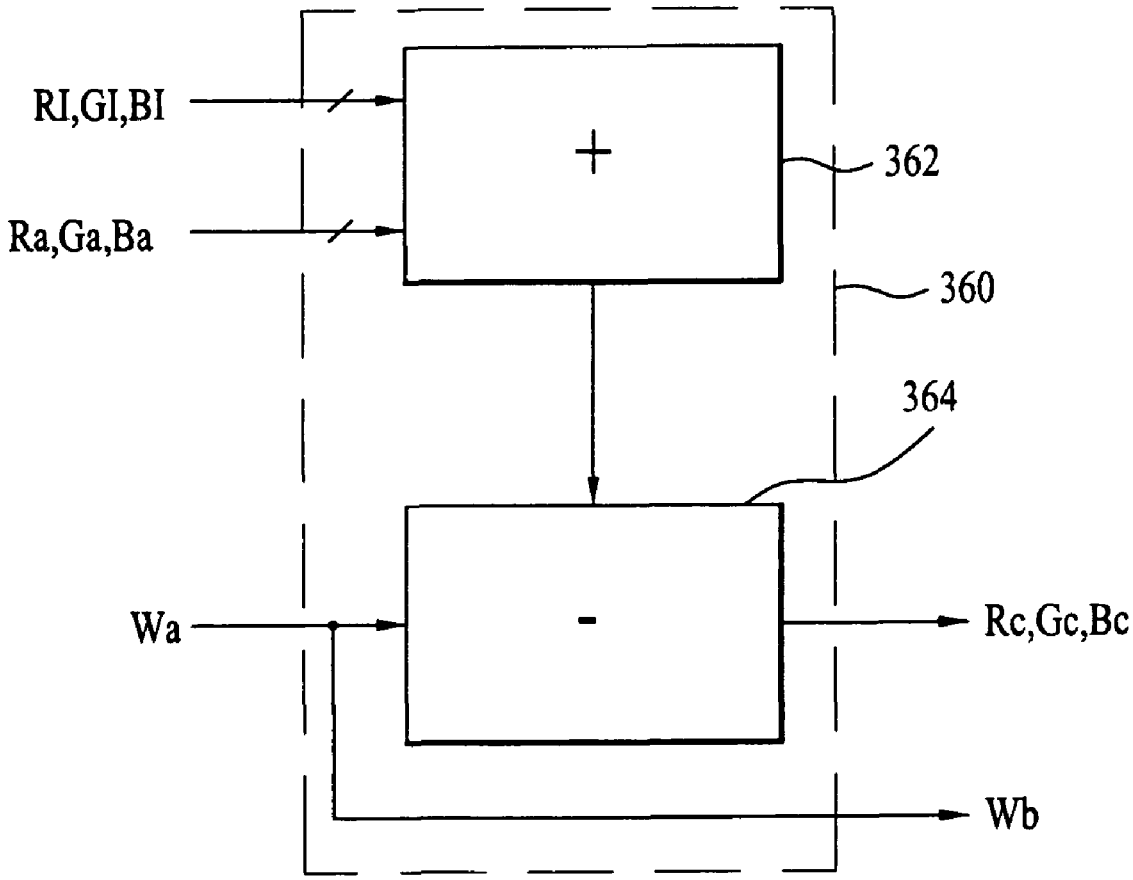
FIG. 6 is a block diagram of a color correction part shown in FIG. 4.

As shown in FIG. 6, the color correction part 360 includes an addition calculation portion 362 and a subtraction calculation portion 364. The addition calculation portion 362 adds the three-color corrected data RI, GI and BI to the first three-color data Ra, Ga and Ba, and then generates the output signal of the addition result. Then, the subtraction calculation portion 364 subtracts the compensated white color extraction signal αWa from the output signal of the addition calculation portion 362, and then outputs second three-color data Rb, Gb and Bb to the gamma conversion part 370.

The color correction part 360 generates the second three-color data Rb, Gb and Bb by using the addition calculation portion 362 and the subtraction calculation portion 364. Simultaneously, the color correction part 360 outputs the first white color extraction signal Wa as the second white color extraction signal Wb, whereby the second four-color data Rb, Gb, Bb and Wb are supplied to the gamma conversion part 370.

The gamma conversion part 370 performs the gamma correction of the second four-color data Rb, Gb, Bb and Wb from the color correction part 360 according to the equation 14, whereby the second four-color data Rb, Gb, Bb and Wb is converted to the final four-color data Ro, Go, Bo and Wo.

$$Ro=(Rb)^{1/\gamma}$$

$$Go=(Gb)^{1/\gamma}$$

$$Bo=(Bb)^{1/\gamma}$$

$$Wo=(Wb)^{1/\gamma} \qquad \text{equation 14}$$

The gamma correction part 370 converts the four-color data Rb, Gb, Bb and Wb to the final four-color data Ro, Go, Bo and Wo suitable for the driving circuit of the LCD panel 102, according to Look Up Table. Then, the gamma conversion part 370 supplies the final four-color data Ro, Go, Bo and Wo to the timing controller 108.

Eventually, as shown in the following equation 15, the data converter 110 generates the white color extraction signal Wa by using the maximum luminance value YMax and the minimum luminance value YMin of the three-color source data inputted from the outside, generates the final three-color data Ro, Go and Bo with the generated white color extraction signal Wa, and supplies the final four-color data Ro, Go, Bo and Wo including the final three-color data Ro, Go and Bo and the white color extraction signal Wb to the timing controller 108.

If the algorism is W1, W2, W3 or W4 in the table 1, $$Do=\left(DI+\frac{\alpha Wb}{Ymax}DI-\alpha Wb\right)^{1/\lambda}$$

If the algorism is W5 in the table 1, $$Do=\left(DI+\frac{\alpha Ymin}{Ymax-Ymin}DI-\alpha Wb\right)^{1/\lambda} \qquad \text{equation 15}$$

In equation 15, 'Do' corresponds to 'Ro', 'Go' and 'Bo', and 'DI' corresponds to 'RI', 'GI' and 'BI'.

An apparatus and method for driving the LCD device according to the second embodiment of the present invention will be described as follows.

First, the data converter 110 generates the white color numerator and denominator signals Wn and Wd and the data numerator and denominator signals a Dn and Dd, as shown in Table 1, by selecting the maximum luminance value YMax and the minimum luminance value YMin from the luminance detection part 310, the first and second white color signals W2 and W3 from the minimum value calculation part 320, and the three-color corrected data RI, GI and BI from the reverse gamma correction part 300, with the numerator and denominator signal generation part 330 according to the selection signal sel.

Then, the data converter 110 generates the first four-color data Ra, Ga, Ba and Wa including the white color extraction signal Wa according to the white color numerator and denominator signals Wn and Wd and the data numerator and denominator signals αDn and Dd with one division part 350. Also, the data converter 110 performs the addition and the subtraction calculations with the first four-color data Ra, Ga, Ba and Wa and the three-color corrected data RI, GI and BI, whereby the data converter 110 generates the second four-color data Rb, Gb, Bb and Wb. Then, the data converter 110 performs the gamma correction of the second four-color data Rb, Gb, Bb and Wb, whereby the final three-color data Ro, Go and Bo, shown in the equation 15, and the white color data Wo are supplied to the timing controller 108.

The apparatus for driving the LCD device according to the second embodiment of the present invention generates the four-color data RGBW at the same point by the data converter 110 including one division part 350 regardless of the algorithms. Accordingly, it is possible to obtain the rapid calculation speed in the data converter 110 for converting the three-color data RGB to the four-color data RGBW.

As mentioned above, the apparatus and method for driving the LCD device according to the embodiments of the present invention have the following advantages.

In the apparatus and method for driving the LCD device according to the first embodiment of the present invention, it is possible to generate the four-color data at the same time regardless of the algorithms, by using the data converter including one division part. Accordingly, it is possible to obtain the rapid calculation speed in the data converter for converting the three-color data RGB to the four-color data RGBW.

In the apparatus and method for driving the LCD device according to the second embodiment of the present invention, the numerator and denominator values supplied to the division part are calculated with the individual calculation circuits, and the calculated numerator and denominator values are selected by the selection signal, and are supplied to the division part. Thus, it is possible to generate the four-color data at the same time regardless of the algorithms, by using the data converter including one division part. Accordingly, it is possible to obtain the rapid calculation speed in the data converter for converting the three-color data RGB to the four-color data RGBW.

In the apparatus and method for driving the LCD device according to the embodiments of the present invention, it is possible to minimize the calculation time in the data converter since the data converter includes one division part. Also, it is possible to perform the various algorithms for extracting the white color data in one data converter.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving a display device, the display device including a panel having sub-pixels of four colors, the apparatus comprising:

a data driver for supplying video data signals to the respective sub-pixels;

a gate driver for supplying scan signals to the respective sub-pixels;

a data converter for extracting a plurality of white color signals by using three-color source data, and for generating white color data based upon a selection signal, so as to convert the three-color source data to four-color data; and a timing controller for supplying the four-color data outputted from the data converter to the data driver, and controlling the gate driver and the data driver, wherein the data converter includes:

a reverse gamma correction part for generating three-color corrected data by performing reverse gamma correction on the three-color source data;

a luminance detection part for detecting a maximum luminance value and a minimum luminance value from the three-color corrected data;

a minimum value calculation part for generating the plurality of white color signals by using the minimum luminance value;

a white color selection part for selecting one of the minimum luminance value and the plurality of white color signals as white color extraction data based upon the selection signal;

a multiplication part for generating compensated white color extraction data based on the white color extraction data and generating first three-color data by multiplying the three-color corrected data and the compensated white color extraction data, the compensated white color extraction being obtained by multiplying the white color extraction data and a weight factor for each of red, green and blue colors respectively;

a division part for generating second three-color data by dividing the first three-color data by the maximum luminance value;

a color correction part for generating first four-color data by using the white color data, the three-color corrected data and the second three-color data; and a gamma conversion part for generating the four-color data by performing gamma correction on the first four-color data and supplying the four-color date to the timing controller.

2. The apparatus of claim 1, wherein the minimum value calculation part generates a first white color signal which is a function of $\{255\times(\text{the minimum luminance value}/255)^2\}$, and a second white color signal which is a function of $\{(-\text{the minimum luminance value}/255^2)+(\text{the minimum luminance value}^2/255)+\text{the minimum luminance value}\}$, and then supplies the first and second white color signals to the white color selection part.

3. The apparatus of claim 2, wherein the minimum value calculation part includes an eight-bit shift register to perform division by 255.

4. The apparatus of claim 1, wherein the color correction part includes:

an addition portion for adding the three-color corrected data to the second three-color data; and a subtraction portion for generating third three-color data by subtracting the compensated white color extraction data from a result of a sum of the three-color corrected data and the second three-color data, wherein the color correction part supplies the first four-color data including the white color extraction data and the third three-color data outputted from the subtraction portion.

5. An apparatus for driving a display device, the display device including a panel having sub-pixels of four colors, the apparatus comprising:

a data driver for supplying video data signals to the respective sub-pixels;

a gate driver for supplying scan signals to the respective sub-pixels;

a data converter for extracting a plurality of white color signals by using three-color source data, and for generating white color data based upon a selection signal , so as to convert the three-color source data to four-color data; and a timing controller for supplying the four-color data outputted from the data converter to the data driver, and controlling the gate driver and the data driver, wherein the data converter includes:

a reverse gamma correction part for generating three-color corrected data by performing reverse gamma correction on the three-color source data;

a luminance detection part for detecting a maximum luminance value and a minimum luminance value from the three-color corrected data;

a minimum value calculation part for generating the plurality of white color signals by using the minimum luminance value; and a numerator and denominator signal generation part for generating a white color numerator signal, a white color denominator signal, a data numerator signal and a data denominator signal by using the maximum and minimum luminance values, the plurality of white color signals and the three-color corrected data, and outputting the white color numerator signal, the white color denominator signal, the data numerator signal and the data denominator signal, based upon the selection signal.

6. The apparatus of claim 5, wherein the numerator and denominator signal generation part includes:

a selector for outputting first and second luminance signals, the white color denominator signal and the data denominator signal, based upon the selection signal;

a first multiplier for generating the white color numerator signal by multiplying the first luminance signal and the second luminance signal;

a second multiplier for generating the data numerator signal by multiplying the second luminance signal and the three-color corrected data; and a third multiplier for outputting a compensated data numerator signal by multiplying the data numerator signal and a weight factor for each of red, green and blue colors respectively.

7. The apparatus of claim 6, wherein the first luminance signal is selected from one of '0', '1' and the maximum luminance value, based upon the selection signal.

8. The apparatus of claim 6, wherein the second luminance signal is selected from one of '0', the minimum luminance value, the maximum luminance value, the first white color signal and the second white color signal, based upon the selection signal.

9. The apparatus of claim 6, wherein the white color denominator signal is selected from one of '1' and a result of a subtraction of the minimum luminance value from the maximum luminance value, based upon the selection signal.

10. The apparatus of claim 6, wherein the data denominator signal is selected from one of '1', the maximum luminance value and a difference between the maximum luminance value and the minimum luminance value, based upon the selection signal.

11. The apparatus of claim 5, wherein the data converter includes a division part for generating first four-color data by performing the division calculation with the white color numerator and denominator signals and the data numerator and denominator signals;

a color correction part for generating second four-color data by using the first four-color data and the three-color corrected data; and a gamma conversion part for generating the four-color data by performing the gamma correction on the second four-color data, and supplying the four-color data to the timing controller.

12. The apparatus of claim 11, wherein the division part generates a white color extraction data by dividing the white color numerator signal with the white color denominator signal, generates the first three-color data by dividing the compensated data numerator signal with the data denominator signal, and supplies the first four-color data including the white color extraction data and the first three-color data.

13. The apparatus of claim 12, wherein the white color extraction data is selected from one of the minimum luminance value, the first white color signal, the second white color signal, the maximum luminance signal, and {(the maximum luminance value×the minimum luminance value)/(the maximum luminance value−the minimum luminance value)}.

14. The apparatus of claim of claim 12, wherein the color correction part generates a compensated white color extraction data by multiplying the white color extraction data and a weight factor for each of red, green and blue colors respectively.

15. The apparatus of claim 14, wherein the color correction part includes an addition portion for adding the three-color corrected data to the first three-color data; and a subtraction portion for generating second three-color data by subtracting the compensated white color extraction data from a result of a sum of the three-color corrected data and the first three-color data; and the color correction part supplies the second four-color data including the second three-color data and the white color extraction data.

16. A method for driving a display device, the display device including a panel having sub-pixels of four colors, a data driver for supplying video data signals to the sub-pixels, and a gate driver for supplying scan signals to the sub-pixels, comprising:

generating three-color corrected data by performing reverse gamma correction in the three-color source data;

detecting a maximum luminance value and a minimum luminance value from the three-color corrected data;

generating the plurality of white color signals by using the minimum luminance value;

selecting one of the minimum luminance value and the plurality of white color signals as white color extraction data based upon the selection signal;

generating a compensated white color extraction data by multiplying the white color extraction data and a weight factor for each of red, green and blue colors respectively;

generating first three-color data by multiplying the compensated white color extraction data and the three-color corrected data;

generating the scan signals; and converting the four-color data to the video data signals, and supplying the video data signals synchronized with the scan signals to the sub-pixels.

17. The method of claim 16, wherein the step of generating the plurality of white color signals includes:

generating a first white color signal which is a function of $\{255\times(\text{the minimum luminance value}/255)^2\}$; and generating a second white color signal which is a function of $\{(-\text{the minimum luminance value}/255^2)+(\text{the minimum luminance value}^2/255)+\text{the minimum luminance value}\}$.

18. The method of claim 17, wherein in the steps of generating the first white color signal and generating the second white color signal includes using an eight-bit shift register to perform division by 255.

19. The method of claim 16, wherein the step of converting the three-color source data to the four-color data includes generating second three-color data by dividing the first three-color data by the maximum luminance value;

generating first four-color data by using the white color extraction data, the three-color corrected data and the second three-color data; and generating the four-color data by performing gamma correction on the first four-color data.

20. The method of claim 19, wherein the step of generating the first four-color data includes:

adding the three-color corrected data to the second three-color data; and generating third three-color data by subtracting the white color data from a result of a sum of the three-color corrected data and the second three-color data, the first four-color data including the white color extraction data and the third three-color data.

21. A method for driving a display device, the display device including a panel having sub-pixels of four colors, a data driver for supplying video data signals to the sub-pixels, and a gate driver for supplying scan signals to the sub-pixels, comprising:

generating three-color corrected data by performing reverse gamma correction in the three-color source data;

detecting a maximum luminance value and a minimum luminance value from the three-color corrected data;

generating the plurality of white color signals by using the minimum luminance value; and generating a white color numerator signal, a white color denominator signal, a data numerator signal and a data denominator signal for division by using the maximum and minimum luminance values, the plurality of white color signals and the three-color corrected data, and outputting the white color numerator and denominator signals and the data numerator and denominator signals based upon the selection signal.

22. The method of claim 21, wherein the step of outputting the white color numerator and denominator signals and the data numerator and denominator signals based upon the selection signal includes:

outputting the first and second luminance signals, the white color denominator signal and the data denominator signal, based upon the selection signal;

generating the white color numerator signal by multiplying the first luminance signal and the second luminance signal; and generating the data numerator signal by multiplying the second luminance signal and the three-color corrected data.

23. The method of claim 22, wherein the step of outputting the first luminance signal includes selectively outputting one of '0', '1' and the maximum luminance value, based upon the selection signal.

24. The method of claim 22, wherein the step of outputting the second luminance signal includes selectively outputting one of '0', the minimum luminance value, the maximum luminance value, the first white color signal and the second white color signal, based upon the selection signal.

25. The method of claim 22, wherein the step of outputting the white color denominator signal includes selectively outputting one of '1' and a difference between the maximum luminance value and the minimum luminance value, based upon the selection signal, based upon the selection signal.

26. The method of claim 22, wherein the step of outputting the data denominator signal selectively outputting one of '1', the maximum luminance value, and a difference between the maximum luminance value and the minimum luminance value, based upon the selection signal, based upon the selection signal.

27. The method of claim 21, wherein the step of converting the three-color source data to the four-color data includes generating first four-color data by performing the division with the white color numerator and denominator signals and the data numerator and denominator signals;

generating second four-color data by using the first four-color data and the three-color corrected data; and generating the four-color data by performing gamma correction on the second four-color data.

28. The method of claim 27, wherein the step of generating the first four-color data includes:

generating a white color extraction data by dividing the white color numerator signal by the white color denominator signal, generating the first three-color data by dividing the data numerator signal by the data denominator signal, and generating the first four-color data including the white color extraction data and the first three-color data.

29. The method of claim 28, wherein the white color extraction data is selected from one of the minimum luminance value, the first white color signal, the second white color signal, the maximum luminance signal, and {(the maximum luminance value×the minimum luminance value)/(the maximum luminance value−the minimum luminance value)}.

30. The method of claim 28, wherein the step of generating the first four-color data further includes generating a compensated white color extraction data by multiplying the white color extraction data and a weight factor for each of red, green and blue colors respectively.

31. The method of claim 30, wherein the step of generating the second four-color data includes adding the three-color corrected data to the first three-color data, and generating second three-color data by subtracting the compensated white color extraction data from a sum of the three-color corrected data and the first three-color data, the second four-color data including the white color extraction data and the second three-color data.

* * * * *